US011699854B2

(12) United States Patent
Wang

(10) Patent No.: US 11,699,854 B2
(45) Date of Patent: Jul. 11, 2023

(54) ANTENNA, TERMINAL MIDDLE-FRAME, AND TERMINAL

(71) Applicant: BEIJING XIAOMI MOBILE SOFTWARE CO., LTD., Beijing (CN)

(72) Inventor: Yali Wang, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 256 days.

(21) Appl. No.: 16/814,872

(22) Filed: Mar. 10, 2020

(65) Prior Publication Data

US 2021/0151887 A1 May 20, 2021

(30) Foreign Application Priority Data

Nov. 20, 2019 (CN) ..... 201911143009.7

(51) Int. Cl.

| | |
|---|---|
| ***H01Q 5/385*** | (2015.01) |
| ***H01Q 5/371*** | (2015.01) |
| ***H01Q 1/24*** | (2006.01) |
| ***H01Q 1/48*** | (2006.01) |
| ***H01Q 1/52*** | (2006.01) |

(52) U.S. Cl.

CPC ..... *H01Q 5/385* (2015.01); *H01Q 1/243* (2013.01); *H01Q 1/48* (2013.01); *H01Q 1/523* (2013.01); *H01Q 5/371* (2015.01)

(58) Field of Classification Search

CPC combination set(s) only.
See application file for complete search history.

(56) References Cited

U.S. PATENT DOCUMENTS

| | | | | |
|---|---|---|---|---|
| 7,525,502 | B2 | 4/2009 | Hui | |
| 9,960,487 | B2 | 5/2018 | Gears | |
| 10,003,127 | B2 | 6/2018 | Liu et al. | |
| 10,186,770 | B2 | 1/2019 | Gears et al. | |
| 10,741,916 | B2 * | 8/2020 | Li | H01Q 1/521 |

(Continued)

FOREIGN PATENT DOCUMENTS

| | | | |
|---|---|---|---|
| CN | 101953023 | A | 1/2011 |
| CN | 105633547 | A | 6/2016 |

(Continued)

OTHER PUBLICATIONS

Supplementary European Search Report in the European application No. 20163640.4, dated Sep. 29, 2020.

(Continued)

*Primary Examiner* — Ricardo I Magallanes
(74) *Attorney, Agent, or Firm* — Syncoda LLC; Feng Ma

(57) ABSTRACT

An antenna includes: a first antenna portion and a second antenna portion arranged adjacently. The first antenna portion includes a first antenna branch and a first parasitic branch, and the second antenna portion includes a second antenna branch. The first parasitic branch is positioned between the first antenna branch and the second antenna branch. The first parasitic branch is L-shaped, and includes a first branch segment and a second branch segment. A first end of the first branch segment is in contact to a ground region, a second end of the first branch segment is joined to a first end of the second branch segment, and a second end of the second branch segment points towards the second antenna branch.

15 Claims, 7 Drawing Sheets

(56) References Cited

U.S. PATENT DOCUMENTS

| | | | | |
|---|---|---|---|---|
| 2003/0174091 | A1* | 9/2003 | Mendolia | B29C 45/14655 343/702 |
| 2006/0038736 | A1 | 2/2006 | Hui | |
| 2009/0174611 | A1* | 7/2009 | Schlub | H01Q 9/0407 343/702 |
| 2011/0169703 | A1 | 7/2011 | Schlub | |
| 2012/0169550 | A1 | 7/2012 | Schlub | |
| 2012/0319916 | A1 | 12/2012 | Gears | |
| 2013/0099980 | A1* | 4/2013 | Hayashi | H01Q 5/385 343/700 MS |
| 2014/0139392 | A1* | 5/2014 | Wong | H01Q 1/521 343/841 |
| 2014/0266938 | A1* | 9/2014 | Ouyang | H01Q 5/321 343/729 |
| 2016/0322699 | A1* | 11/2016 | Mow | H01Q 13/10 |
| 2017/0062932 | A1 | 3/2017 | Foster et al. | |
| 2017/0271759 | A1 | 9/2017 | Liu et al. | |
| 2018/0219284 | A1 | 8/2018 | Gears et al. | |
| 2019/0006734 | A1 | 1/2019 | Svendsen et al. | |
| 2019/0280378 | A1 | 9/2019 | Gears et al. | |
| 2022/0094038 | A1* | 3/2022 | Wang | H01Q 1/38 |

FOREIGN PATENT DOCUMENTS

| | | | |
|---|---|---|---|
| CN | 205452544 | U | 8/2016 |
| CN | 104103888 | B | 9/2016 |
| CN | 107112630 | A | 8/2017 |
| CN | 108123209 | A | 6/2018 |
| CN | 109565107 | A | 4/2019 |
| CN | 109616768 | A | 4/2019 |
| EP | 2083472 | A1 | 7/2009 |
| EP | 2518824 | A1 | 10/2012 |
| JP | 2011102143 | A | 5/2011 |
| JP | 5076019 | B1 | 11/2012 |
| KR | 20120044229 | A | 5/2012 |
| KR | 20140034932 | A | 3/2014 |
| KR | 20170140854 | A | 12/2017 |
| WO | 2014161564 | A1 | 10/2014 |
| WO | 2016115697 | A1 | 7/2016 |
| WO | 2018089947 | A1 | 5/2018 |

OTHER PUBLICATIONS

International Search Report in the international application No. PCT/CN2020/074183, dated Aug. 13, 2020.

First Office Action of the Japanese application No. 2020-515684, dated Feb. 4, 2022.

* cited by examiner

ANTENNA, TERMINAL MIDDLE-FRAME, AND TERMINAL

CROSS-REFERENCE TO RELATED APPLICATION

This application claims priority to Chinese patent application No. 201911143009.7 filed on Nov. 20, 2019, the disclosure of which is hereby incorporated by reference in its entirety.

BACKGROUND

As diversification of functions of mobile terminals, requirements on the number and functions of antennas inside the mobile terminals have increased gradually.

SUMMARY

The present disclosure generally relates to the field of communication hardware, and more specifically to an antenna, a terminal middle-frame, and a terminal.

In an aspect, an antenna is provided. The antenna includes: a first antenna portion and a second antenna portion arranged adjacently. The first antenna portion includes a first antenna branch and a first parasitic branch, and the second antenna portion includes a second antenna branch; the first parasitic branch is positioned between the first antenna branch and the second antenna branch; the first parasitic branch is L-shaped, and the first parasitic branch includes a first branch segment and a second branch segment; and a first end of the first branch segment is in contact to a ground region, a second end of the first branch segment is joined to a first end of the second branch segment, and a second end of the second branch segment points towards the second antenna branch.

In another aspect, a terminal middle-frame is provided. The terminal middle-frame is installed with any antenna as described above.

In another aspect, a terminal is provided. The terminal is installed with any antenna as described above.

BRIEF DESCRIPTION OF THE DRAWINGS

The accompanying drawings referred to in the specification are a part of this disclosure, and provide illustrative embodiments consistent with the disclosure and, together with the detailed description, serve to illustrate some embodiments of the disclosure.

DETAILED DESCRIPTION

Figure 1:
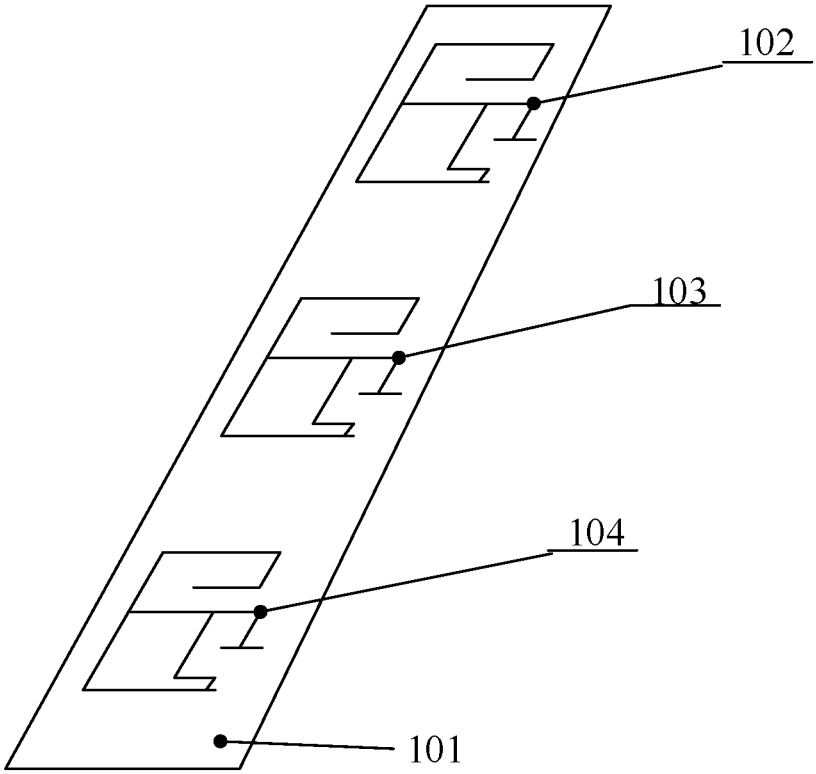
FIG. 1 illustrates a structural schematic diagram of an arrangement of antenna portions.

Exemplary embodiments (examples of which are illustrated in the accompanying drawings) are elaborated below. The following description refers to the accompanying drawings, in which identical or similar elements in two drawings are denoted by identical reference numerals unless indicated otherwise. The exemplary implementation modes may take on multiple forms, and should not be taken as being limited to examples illustrated herein. Instead, by providing such implementation modes, embodiments herein may become more comprehensive and complete, and comprehensive concept of the exemplary implementation modes may be delivered to those skilled in the art. Implementations set forth in the following exemplary embodiments do not represent all implementations in accordance with the subject disclosure. Rather, they are merely examples of the apparatus and method in accordance with certain aspects herein as recited in the accompanying claims.

In order to adapt to both the communication and function requirements of the mobile terminal, and the spatially compact arrangement inside the mobile terminal, antennas inside the mobile terminal are mostly made of an industrial liquid crystal polymer (LCP). In order to adapt to the communication requirements of the mobile terminal, multiple antenna portions may also be integrated on the LCP antenna inside the mobile terminal.

However, the integration of multiple antenna portions on the LCP antenna may easily lead to electromagnetic coupling between the antenna portions, and thus cause isolation between two immediate antenna portions, affecting the normal operation of the antenna.

First of all, nouns involved in embodiments of the disclosure are briefly introduced.

Electromagnetic coupling: is also referred to as mutual inductance coupling, and is a phenomenon that, due to the existence of mutual inductance between two circuits, a current change in one of the circuits has an influence on the other of the circuits via the mutual inductance. When there is tight cooperation and mutual influence between an input and output of two or more circuit elements or electric networks, energy will be transmitted from one side to the other side through interaction. When two set of antennas close to each other are operating simultaneously, the two set of antennas will also have an influence on each other due to the mutual inductance phenomenon, that is, producing electromagnetic interference to each other.

Antenna isolation degree: is used to quantitatively characterize the strength of electromagnetic coupling between the antennas (or antenna portions), is defined as the ratio of the transmission power of one antenna to the receiving power of the other antenna, and is in unit of dB. When the antenna isolation degree is low, it means that the two antennas may easily produce electromagnetic interference to each other, and have an influence on the transmission efficiency of each other. Generally, in an existing communication terminal, it should be ensured that the isolation degree between two antennas in a same terminal is smaller than or equal to −15 dB.

FIG. 1 illustrates a schematic diagram of an antenna. Referring to FIG. 1, explanation is made with the antenna implemented as an LCP antenna as an example, there is an antenna portion 102, an antenna portion 103 and an antenna portion 104 on the LCP antenna 101. In some embodiments, the arrangement on the LCP antenna 101 is spatially compact; therefore, the arrangement of the antenna portions is also compact, and distances between the antenna portions are small.

Figure 2:
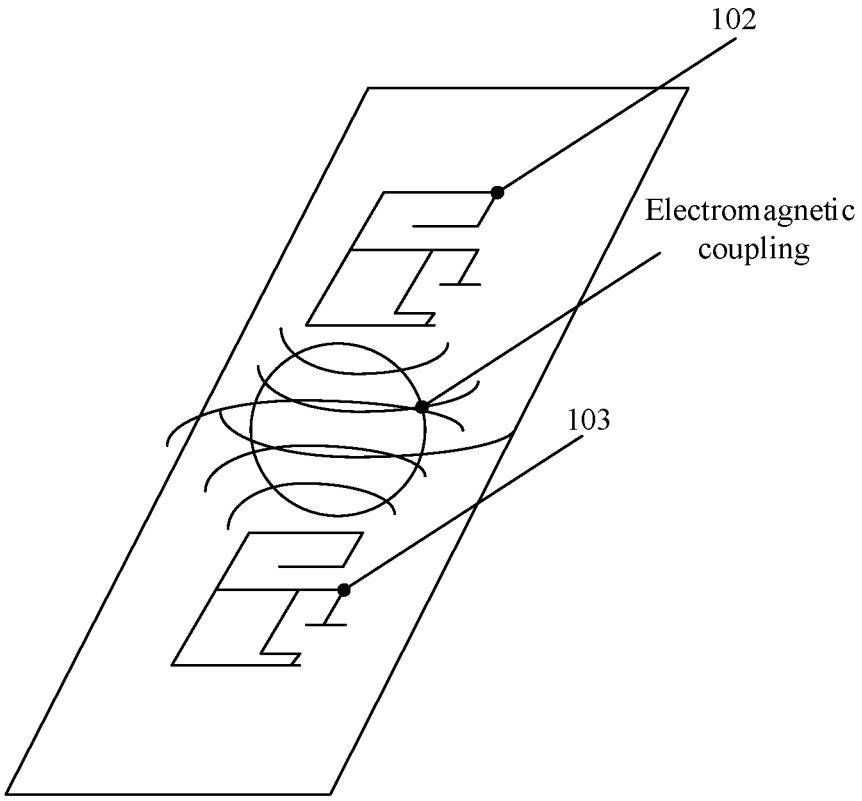
FIG. 2 illustrates a theoretical schematic diagram of an electromagnetic coupling phenomenon produced between two antenna portions in the arrangement of antenna portions of FIG. 1.

FIG. 2 illustrates a theoretical schematic diagram of electromagnetic coupling produced between two antennas of FIG. 1. Referring to FIG. 2, the distance between the antenna 102 and the antenna 103 is small, and therefore, strong electromagnetic coupling will be produced. When electromagnetic coupling is produced between the antenna 02 and the antenna 103, there is a current between the antenna 102 and the antenna 103 due to that the antenna 102 and the antenna 103 are both in a live work state. Exemplarily, when both the antenna 102 and the antenna 103 are in the live work state, mutual inductance may be easily produced between the antenna portions due to that the currents in the antenna portions are not constant in the work state. At this time, a surface wave current may be produced due to mutual interference between signals emitted by the antenna 102 and the antenna 103 respectively. The surface wave current further affects the normal operation of the antenna 102 and the antenna 103.

Figure 3:
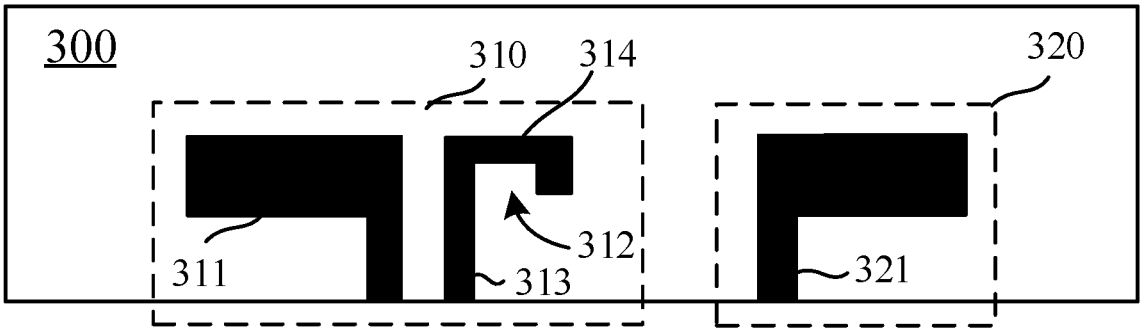
FIG. 3 illustrates a structural schematic diagram of the arrangement of antenna portions according to some embodiments of the disclosure.

FIG. 3 illustrates a schematic diagram of an antenna 300 according to some embodiments of the disclosure. The antenna 300 includes: a first antenna portion 310 and a second antenna portion 320 arranged adjacently.

The first antenna portion 310 includes a first antenna branch 311 and a first parasitic branch 312, and the second antenna portion 320 includes a second antenna branch 321. The first parasitic branch 312 is positioned between the first antenna branch 311 and the second antenna branch 321, and the first parasitic branch 312 is L-shaped. The first parasitic branch 312 includes a first branch segment 313 and a second branch segment 314. A first end of the first branch segment 313 is in contact to a ground region, a second end of the first branch segment 313 is joined to a first end of the second branch segment 314, and a second end of the second branch segment 314 points towards the second antenna branch 321.

In some embodiments, the first branch segment 313 and the second branch segment 314 may be implemented as a branch entirety pointing towards two directions, or may be implemented as two discrete branch segments joined to each other.

In some embodiments, since the first parasitic branch 312 is L-shaped, the first parasitic branch 312 may be composed by the first branch segment 313 and the second branch segment 314 only, or may be composed by the first branch segment 313, the second branch segment 314, and another branch segment. The another branch segment is joined to the second branch segment 314.

In some embodiments, as illustrated in FIG. 3, both the first antenna branch 311 and the second antenna branch 321 are L-shaped, and the first antenna branch 311 and the second antenna branch 321 run opposite to each other. That is to say, the L shape of the first antenna branch 311 is oriented opposite to that of the second antenna branch 321, and the L shape of the second antenna branch 321 is oriented opposite to that of the first antenna branch 311.

In some embodiments, a frequency band of the first antenna portion 310 and a frequency band of the second antenna portion 320 are identical; or the frequency band of the first antenna portion 310 and the frequency band of the second antenna portion 320 contain a same frequency band; or the frequency band of the first antenna portion 310 and the frequency band of the second antenna portion 320 contain respective frequency bands have a frequency difference between each other that is smaller than a required frequency difference.

In some embodiments, the first parasitic branch 312 is implemented as a part of the first antenna portion 310. Therefore, specific resonance may be formed by a specific wavelength in a specific environment, so that the first parasitic branch 312 may radiate in a specific frequency band to realize signal transceiving.

In some embodiments, in embodiments of the disclosure, explanation is made with the first antenna portion 310 and the second antenna portion 320 arranged on an industrial liquid crystal polymer (LCP) material as an example. That is to say, the first antenna portion 310 and the second antenna portion 320 are arranged on an LCP board.

In some embodiments, the first antenna portion 310 and the second antenna portion 320 may also be arranged on a terminal middle-frame by means of laser direct structuring (LDS); or the first antenna portion 310 and the second antenna portion 320 may be arranged on a flexible printed circuit (FPC) board or a modified polyimide (MPI) board. The arrangement of the first antenna portion 310 and the second antenna portion 320 are not specified in embodiments of the disclosure.

In some embodiments, the ground region is covered with a conductive material; or the ground region is made of a conductive material.

With the first antenna portion 310 and the second antenna portion 320 arranged on the LCP antenna as an example, the operation principle of the antenna provided in embodiments of the disclosure is elaborated.

The first antenna portion 310 and the second antenna portion 320 are arranged on an LCP board. Since multiple antenna portions may be implemented on the LCP board, and the multiple antenna portions are closely adjacent to one another, when a frequency band of the first antenna portion 310 and a frequency band of the second antenna portion 320 are identical, or contain a same frequency band, or contain respective frequencies close to each other, surface waves produced by the first antenna portion 310 and the second antenna portion 320 have an influence on the radio-frequency operation of the two antenna portions. In some embodiments, the first antenna portion 310 and the second antenna portion 320 may be connected to the other terminal components, so as to ensure that the first antenna portion 310 and the second antenna portion 320 can be powered on normally. The first parasitic branch 312 in the first antenna portion 310 is arranged between the first antenna branch 311 and the second antenna branch 321. The first parasitic branch 312 is L-shaped, where the L shape is composed by the first branch segment 313 and the second branch segment 314. The first branch segment 313 is grounded, and the second branch segment 314 points towards the second antenna branch 321. When surface waves are produced between the first antenna branch 311 and the second antenna branch 321 due to signal interference, the first antenna branch 311 and the second antenna branch 321 excite the first parasitic branch 312 to generate a reverse current, to counteract the surface waves so as to reduce the isolation degree.

In summary, in the antenna provided in embodiments of the disclosure, each of the antenna portions is decomposed into an antenna branch and a parasitic branch, and the parasitic branch is configured to be L-shaped and placed between two immediate antenna branches. As such, the two antenna branches excite the parasitic branch to generate a reverse current, so as to counteract surface waves, reduce electromagnetic coupling between antenna portions, reduce the isolation degree between the antenna portions, and improve the accuracy of operation of the antenna portions.

Figure 4:
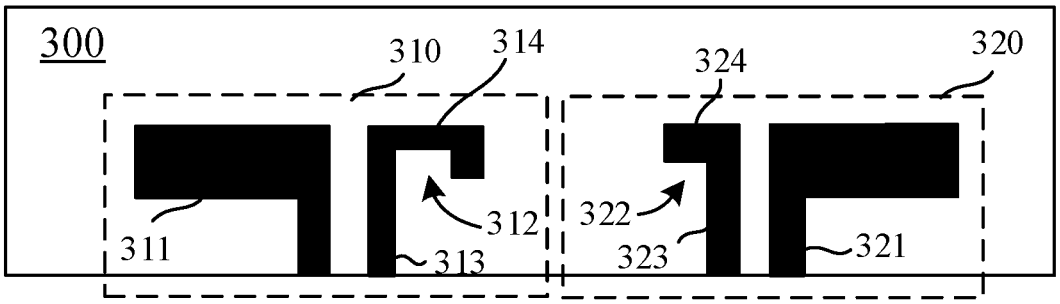
FIG. 4 illustrates a structural schematic diagram of the arrangement of antenna portions according to some embodiments of the disclosure.

In some embodiments, referring to FIG. 4, the second antenna portion 320 includes the second antenna branch 321 and the second parasitic branch 322. As illustrated in FIG. 4, the second parasitic branch 322 is positioned between the first parasitic branch 312 and the second antenna branch 321.

The second parasitic branch 322 is L-shaped, and the second parasitic branch 322 includes a third branch segment 323 and a fourth branch segment 324. A first end of the third branch segment 323 is in contact to the ground region, a second end of the third branch segment 323 is joined to a first end of the fourth branch segment 324, and a second end of the fourth branch segment 324 points towards the first antenna branch 311.

In some embodiments, the second parasitic branch 322 is L-shaped. That is to say, the second parasitic branch 322 may be composed by the third branch segment 323 and the fourth branch segment 324, or may be composed by the third branch segment 323, the fourth branch segment 324 and another branch segment. The another branch segment is joined to the fourth branch segment 324.

With the first antenna portion 310 and the second antenna portion 320 arranged on the LCP antenna as an example, the operation principle of the antenna provided in embodiments of the disclosure is elaborated as follows.

The first antenna portion 310 and the second antenna portion 320 are arranged on an LCP board. The first parasitic branch 312 in the first antenna portion 310 and the second parasitic branch 322 in the second antenna portion 320 are arranged between the first antenna branch 311 and the second antenna branch 321, and the first parasitic branch 312 is arranged between the first antenna branch 311 and the second parasitic branch 322. Similarly, the second parasitic branch 322 is arranged between the first parasitic branch 312 and the second antenna branch 321. The first parasitic branch 312 is L-shaped, where the L shape is composed by the first branch segment 313 and the second branch segment 314. The first branch segment 313 is grounded, and the second branch segment 314 points towards the second antenna branch 321. The second parasitic branch 322 is L-shaped, where the L shape is composed by the third branch segment 323 and the fourth branch segment 324. The third branch segment 323 is grounded, and the fourth branch segment 324 points towards the first antenna branch 311. When surface waves are produced between the first antenna branch 311 and the second antenna branch 321 due to signal interference, the first antenna branch 311 and the second antenna branch 321 excite the first parasitic branch 312 and the second parasitic branch 322 to generate a reverse current, to counteract the surface waves so as to reduce the isolation degree.

In summary, in the antenna provided in embodiments of the disclosure, each of the antenna portions is decomposed into an antenna branch and a parasitic branch, and the parasitic branch is configured to be L-shaped and placed between two immediate antenna branches. As such, the two antenna branches excite the parasitic branch to generate a reverse current, so as to counteract surface waves, reduce electromagnetic coupling between antenna portions, reduce the isolation degree between the antenna portions, and improve the accuracy of operation of the antenna portions.

Figure 5:
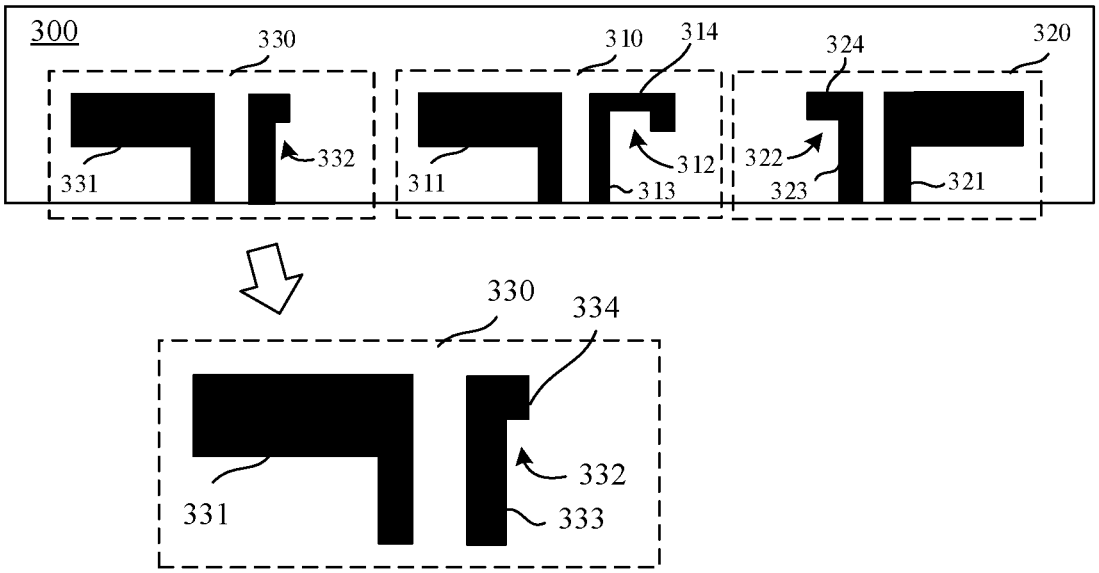
FIG. 5 illustrates a structural schematic diagram of the arrangement of a first antenna portion, a second antenna portion and a third antenna portion in some embodiments of the disclosure.

In some embodiments, the antenna 300 further includes a third antenna portion. Exemplarily, referring to FIG. 5 which illustrates a structural schematic diagram of the arrangement of a first antenna portion, a second antenna portion and a third antenna portion in some embodiments of the disclosure. As illustrated in FIG. 5, the antenna 300 includes the first antenna portion 310 and the second antenna portion 320. The antenna 300 further includes a third antenna portion 330. The first antenna portion 310, the second antenna portion 320 and the third antenna portion 330 are arranged in a line in the antenna 300.

In some embodiments, as illustrated in FIG. 5, the first antenna portion 310 is positioned between the third antenna portion 330 and the second antenna portion 320. The third antenna portion 330 includes a third antenna branch 331 and a third parasitic branch 332. The third parasitic branch 332 is positioned between the third antenna branch 331 and the first antenna branch 311. In some embodiments, the third parasitic branch 332 is L-shaped, and the third parasitic branch 332 includes a fifth branch segment 333 and a sixth branch segment 334. A first end of the fifth branch segment 333 is in contact to the ground region, a second end of the fifth branch segment 333 is in contact to a first end of the sixth branch segment 334, and a second end of the sixth branch segment 334 points towards the first antenna branch 311.

In some embodiments, since the third parasitic branch 332 is L-shaped, the third parasitic branch 332 may be composed by the fifth branch segment 333 and the sixth branch segment 334, or may be composed by the fifth branch segment 333, the sixth branch segment 334 and another branch segment. The another branch segment is joined to the sixth branch segment 334.

In some embodiments, as illustrated in FIG. 5, the first antenna branch 311, the second antenna branch 321 and the third antenna branch 331 are all L-shaped. The first antenna branch 311 and the second antenna branch 321 run opposite to each other, and the third antenna branch 311 and the first antenna branch 331 run identically to each other. That is to say, the L shape of the first antenna branch 311 is oriented opposite to that of the second antenna branch 321, the L shape of the second antenna branch 321 is oriented opposite to that of the first antenna branch 311, and the L shape of the third antenna branch 331 is oriented opposite to that of the first antenna branch 311.

In some embodiments, a frequency band of the first antenna portion 310 and a frequency band of the third antenna portion 330 are identical; or the frequency band of the first antenna portion 310 and the frequency band of the third antenna portion 330 contain a same frequency band; or the frequency band of the first antenna portion 310 and the frequency band of the third antenna portion 330 contain respective frequency bands having a frequency difference between each other that is smaller than a required frequency difference.

In some embodiments, the third parasitic branch 332 is implemented as a part of the third antenna portion 330. Therefore, specific resonance may be formed by a specific wavelength in a specific environment, so that the third parasitic branch 332 may radiate in a specific frequency band to implement signal transceiving.

In some embodiments, in embodiments of the disclosure, explanation is made with the first antenna portion 310, the second antenna portion 320 and the third antenna portion 330 arranged on an industrial liquid crystal polymer (LCP) material as an example. That is to say, the first antenna portion 310, the second antenna portion 320 and the third antenna portion 330 are arranged on an LCP board.

In some embodiments, the first antenna portion 310, the second antenna portion 320 and the third antenna portion 330 may also be arranged on a terminal middle-frame by means of LDS; or the first antenna portion 310, the second antenna portion 320 and the third antenna portion 330 may be arranged on an FPC board or an MPI board. The arrangement of the first antenna portion 310, the second antenna portion 320 and the third antenna portion 330 is not limited in embodiments of the disclosure.

In some embodiments, the ground region is covered with a conductive material; or the ground region is made of a conductive material.

With regard to the isolation degree between the first antenna portion 310 and the third antenna portion 330, the operation principle of the antenna provided in embodiments of the disclosure is elaborated as follows.

The first antenna portion 310 and the third antenna portion 330 are arranged on an LCP board. Since multiple antenna portions may be implemented on the LCP board, and the multiple antenna portions are closely adjacent to one another, when the frequency band of the first antenna portion 310 and the frequency band of the third antenna portion 330 are identical, or contain a same frequency band, or contain respective frequencies close to each other, surface waves produced between the first antenna portion 310 and the third antenna portion 330 have an influence on the radio-frequency operation of the two antenna portions. In some embodiments, the first antenna portion 310 and the third antenna portion 330 may be connected to the other terminal components, so as to ensure that the first antenna portion 310 and the third antenna portion 330 can be powered on normally. The third parasitic branch 332 in the third antenna portion 330 is arranged between the first antenna branch 311 and the third antenna branch 331, and the third parasitic branch 332 is L-shaped, where the L shape is composed by the fifth branch segment 333 and the sixth branch segment 334. The fifth branch segment 333 is grounded, and the sixth branch segment 334 points towards the first antenna branch 311. When surface waves are produced between the first antenna branch 311 and the third antenna branch 331 due to signal interference, the first antenna branch 311 and the third antenna branch 331 excite the third parasitic branch 332 to generate a reverse current, to counteract the surface waves so as to reduce the isolation degree.

As such, in the antenna provided in embodiments of the disclosure, each of the antenna portions is decomposed into an antenna branch and a parasitic branch, and the parasitic branch is configured to be L-shaped and placed between two immediate antenna branches. As such, the two antenna branches excite the parasitic branch to generate a reverse current, so as to counteract surface waves, reduce electromagnetic coupling between antenna portions, reduce the degree of isolation between the antenna portions, and improve the accuracy of operation of the antenna portions.

It is to be noted that, for the antenna portions in the antenna 300, each antenna portion may be correspondingly provided with an antenna branch and a parasitic branch. It is also feasible that some of the antenna portions are provided with an antenna branch and a parasitic branch, and the other of the antenna portions include an antenna branch only. In some embodiments, there is a parasitic branch between two immediate antenna branches to excite a reverse current and counteract surface waves.

Exemplarily, as illustrated in FIG. 5, the first antenna portion 310 is positioned at the left side of the second antenna portion 320, and the third antenna portion 330 is positioned at the left side of the first antenna portion 310. When a further antenna portion needs to be arranged at the left side of the third antenna portion 330, the further antenna portion may continue to be arranged at the left side of the third antenna portion 330 in the same manner as the third antenna branch 331 and the third parasitic branch 332 in the third antenna portion 330 are arranged.

Figure 6:
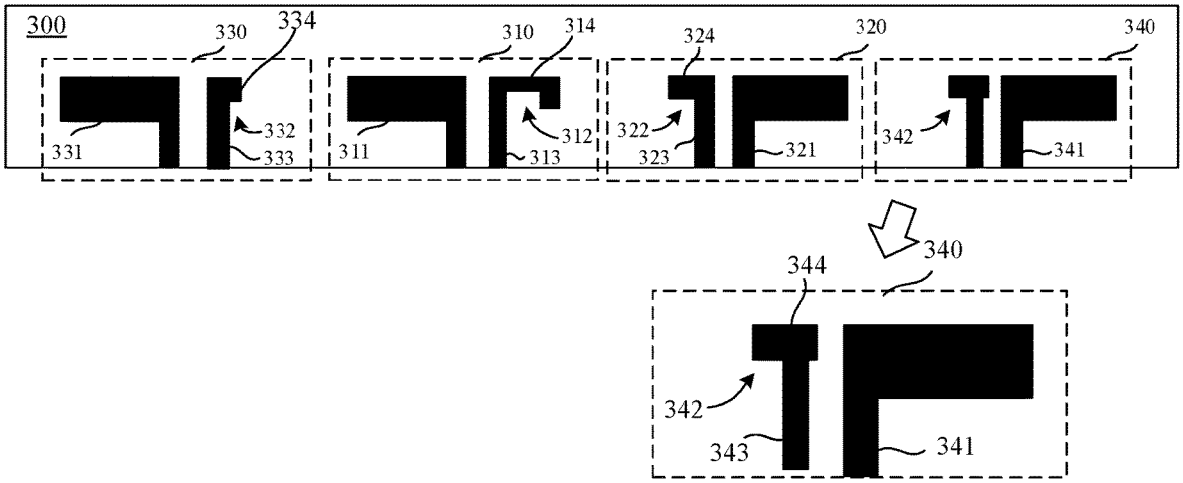
FIG. 6 illustrates a structural schematic diagram of the arrangement of four antenna portions according to some embodiments of the disclosure.
Figure 7:
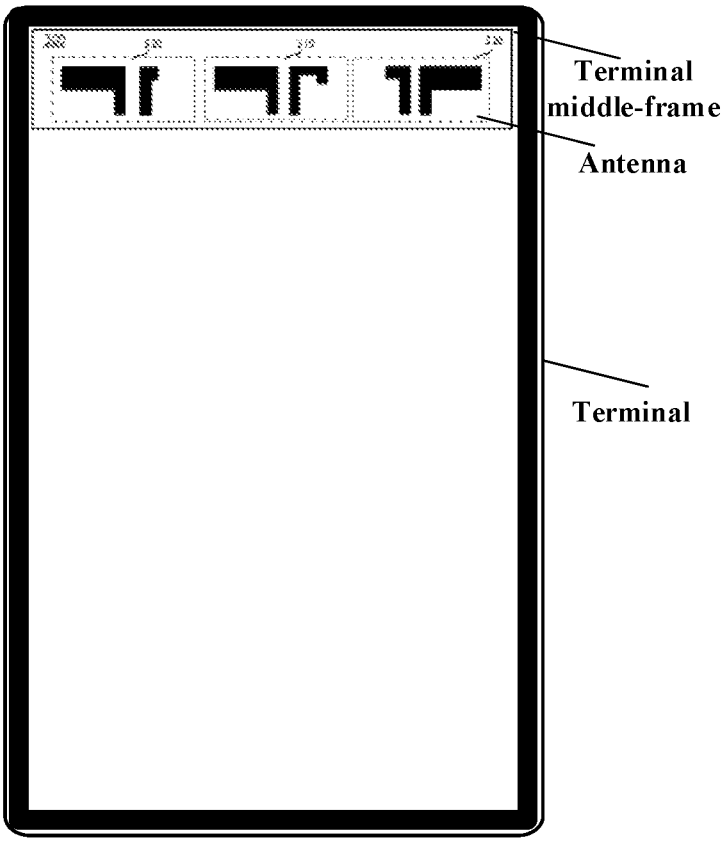
FIG. 7 illustrates a terminal having a middle frame installed with an antenna according to some embodiments of the disclosure.

In some embodiments, there may be a fourth antenna portion arranged at the right side of the second antenna portion 320. Exemplarily, as illustrated in FIG. 6, the fourth antenna portion is arranged at the right side of the second antenna portion 320. The antenna 300 includes the first antenna portion 310, the second antenna portion 320, the third antenna portion 330 and the fourth antenna portion 340 described above. The first antenna portion 310, the second antenna portion 320, the third antenna portion 330 and the fourth antenna portion are arranged in a line in the antenna 300.

In some embodiments, as illustrated in FIG. 6, the fourth antenna portion 340 includes a fourth antenna branch 341 and a fourth parasitic branch 342. The fourth parasitic branch 342 is positioned between the second antenna branch 321 and the fourth antenna branch 341. In some embodiments, the fourth parasitic branch 342 is L-shaped, and the fourth parasitic branch 342 includes a seventh branch segment 343 and an eighth branch segment 344. A first end of the seventh branch segment 343 is in contact to the ground region, a second end of the seventh branch segment 343 is in contact to a first end of the eighth branch segment 344, and a second end of the eighth branch segment 344 points towards the second antenna branch 321.

In some embodiments, as illustrated in FIG. 5, the first antenna branch 311, the second antenna branch 321 and the third antenna branch 331 are all L-shaped. The first antenna branch 311 and the second antenna branch 321 run opposite to each other, and the third antenna branch 311 and the first antenna branch 331 run identically to each other. That is to say, the L shape of the first antenna branch 311 is oriented opposite to that of the second antenna branch 321, the L shape of the second antenna branch 321 is oriented opposite to that of the first antenna branch 311, and the L shape of the third antenna branch 331 is oriented opposite to that of the first antenna branch 311.

Exemplarily, as illustrated in FIG. 6, the fourth antenna portion 340 is positioned at the right side of the second antenna portion 320. When a further antenna portion needs to be arranged at the right side of the fourth antenna portion 340, the further antenna portion may continue to be arranged at the right side of the fourth antenna portion 340 in the same manner as the fourth antenna branch 341 and the fourth parasitic branch 342 in the fourth antenna portion 340 are arranged.

With regard to the isolation degree between the second antenna portion 320 and the fourth antenna portion 340, the operation principle of the antenna provided in embodiments of the disclosure is elaborated as follows.

The second antenna portion 320 and the fourth antenna portion 340 are arranged on an LCP board. Since multiple antenna portions may be implemented on the LCP board, and the multiple antenna portions are closely adjacent to one another, when the frequency band of the second antenna portion 320 and the frequency band of the fourth antenna portion 340 are identical, or contain a same frequency band, or contain close frequencies, surface waves produced between the second antenna portion 320 and the fourth antenna portion 340 have an influence on the radio-frequency operation of the two antenna portions. In some embodiments, the second antenna portion 320 and the fourth antenna portion 340 may be connected to the other terminal components, so as to ensure that the second antenna portion 320 and the fourth antenna portion 340 can be powered on normally. The fourth parasitic branch 342 in the fourth antenna portion 340 is arranged between the second antenna branch 321 and the fourth antenna branch 341. The fourth parasitic branch 342 is L-shaped, where the L shape is composed by the seventh branch segment 343 and the eighth branch segment 344. The seventh branch segment 343 is grounded, and the eighth branch segment 344 points towards the second antenna branch 321. When surface waves are produced between the second antenna branch 321 and the fourth antenna branch 341 due to signal interference, the second antenna branch 321 and the fourth antenna branch 341 excite the fourth parasitic branch 342 to generate a reverse current, to counteract the surface waves so as to reduce the isolation degree.

As such, in the antenna provided in embodiments of the disclosure, each of the antenna portions is decomposed into an antenna branch and a parasitic branch, and the parasitic branch is configured to be L-shaped and placed between two immediate antenna branches. As such, the two antenna branches excite the parasitic branch to generate a reverse current, so as to counteract surface waves, reduce electromagnetic coupling between antenna portions, reduce the isolation degree between the antenna portions, and improve the accuracy of operation of the antenna portions.

A terminal middle-frame is also provided in embodiments of the disclosure. The terminal middle-frame is installed with at least one of the antennas in the embodiments of the disclosure above.

A terminal is also provided in embodiments of the disclosure. The terminal is installed with at least one of the antennas in the embodiments of the disclosure above.

All of the optional technical solutions above may form optional embodiments of the disclosure by any combination, which will not be described herein.

Those of ordinary skill in the art can understand that all or some steps for realizing the embodiments above may be implemented by hardware, or may be completed by hardware instructed by a program. The program may be stored in a computer-readable storage medium which may be a read-only memory, a magnetic disk, an optical disc or the like.

Described above are merely preferred embodiments of the disclosure, and are not used to limit the disclosure. Any modification, equivalent replacement, improvement, etc. made within the spirit and principle of the disclosure should all fall within the scope of the disclosure.

Various embodiments the disclosure can have one or more of the following advantages.

Each of the antenna portions is decomposed into an antenna branch and a parasitic branch, and the parasitic branch is configured to be L-shaped and placed between two immediate antenna branches. As such, the two antenna branches excite the parasitic branch to generate a reverse current, so as to counteract surface waves, reduce electromagnetic coupling between antenna portions, reduce the isolation degree between the antenna portions, and improve the accuracy of operation of the antenna portions.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a standalone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HIVID) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. An antenna, comprising: a first antenna portion and a second antenna portion arranged adjacently, wherein the antenna further comprises a third antenna portion, and the first antenna portion is positioned between the third antenna portion and the second antenna portion;

wherein the first antenna portion comprises a first antenna branch and a first parasitic branch, and the second antenna portion comprises a second antenna branch;

the first parasitic branch is positioned between the first antenna branch and the second antenna branch;

the first parasitic branch comprises a first branch segment, a second branch segment, and an additional branch segment; and a first end of the first branch segment is in contact to a ground region, a second end of the first branch segment is joined to a first end of the second branch segment, and a second end of the second branch segment is joined to a first end of the additional branch segment and points towards the second antenna branch;

wherein the second antenna portion further comprises a second parasitic branch, and the second parasitic branch is positioned between the first parasitic branch and the second antenna branch;

the second parasitic branch is L-shaped, and the second parasitic branch comprises a third branch segment and a fourth branch segment; and a first end of the third branch segment is in contact to the ground region, a second end of the third branch segment is joined to a first end of the fourth branch segment, and a second end of the fourth branch segment points towards the first antenna branch;

wherein the additional branch segment of the first parasitic branch is parallel to the first branch segment of the first parasitic branch, such that the additional branch segment of the first parasitic branch is perpendicular to the fourth branch segment of the second parasitic branch;

wherein the third antenna portion comprises a third antenna branch and a third parasitic branch;

the third parasitic branch is positioned between the third antenna branch and the first antenna branch;

the third parasitic branch is L-shaped, and the third parasitic branch comprises a fifth branch segment and a sixth branch segment; and a first end of the fifth branch segment is in contact to the ground region, a second end of the fifth branch segment is joined to a first end of the sixth branch segment, and a second end of the sixth branch segment points towards the first antenna branch; and wherein the first antenna branch and the second antenna branch run opposite to each other, and the second antenna branch and the third antenna branch run opposite to each other.

2. The antenna according to claim 1, wherein the first antenna branch and the second antenna branch are L-shaped.

3. The antenna according to claim 1, wherein a frequency band of the first antenna portion and a frequency band of the second antenna portion are identical; or the frequency band of the first antenna portion and the frequency band of the second antenna portion contain a same frequency band; or the frequency band of the first antenna portion and the frequency band of the second antenna portion contain respective frequency bands having a frequency difference between each other that is smaller than a required frequency difference.

4. The antenna according to claim 1, wherein the first antenna portion, the second antenna portion and the third antenna portion are arranged in a line in the antenna.

5. The antenna according to claim 1, wherein the first antenna portion and the second antenna portion are arranged on an industrial liquid crystal polymer material.

6. A mobile terminal comprising the antenna of claim 1, comprising a plurality of antenna portions each decomposed into an antenna branch and a parasitic branch, wherein the parasitic branch is configured to be L-shaped and placed between two neighboring antenna branches such that the two neighboring antenna branches excite the parasitic branch to generate a reverse current, so as to counteract surface waves, reduce electromagnetic coupling between the plurality of antenna portions, reduce a degree of isolation degree between the plurality of antenna portions, and improve accuracy of operation of the plurality of antenna portions.

7. A terminal middle-frame, wherein the terminal middle-frame is installed with an antenna, wherein the antenna comprises: a first antenna portion and a second antenna portion arranged adjacently, wherein the antenna further comprises a third antenna portion, and the first antenna portion is positioned between the third antenna portion and the second antenna portion;

wherein the first antenna portion comprises a first antenna branch and a first parasitic branch, and the second antenna portion comprises a second antenna branch;

the first parasitic branch is positioned between the first antenna branch and the second antenna branch;

the first parasitic branch comprises a first branch segment, a second branch segment, and an additional branch segment; and a first end of the first branch segment is in contact to a ground region, a second end of the first branch segment is joined to a first end of the second branch segment, and a second end of the second branch segment is joined to a first end of the additional branch segment and points towards the second antenna branch;

wherein the second antenna portion further comprises a second parasitic branch, and the second parasitic branch is positioned between the first parasitic branch and the second antenna branch;

the second parasitic branch is L-shaped, and the second parasitic branch comprises a third branch segment and a fourth branch segment; and a first end of the third branch segment is in contact to the ground region, a second end of the third branch segment is joined to a first end of the fourth branch segment, and a second end of the fourth branch segment points towards the first antenna branch;

wherein the additional branch segment of the first parasitic branch is parallel to the first branch segment of the first parasitic branch, such that the additional branch segment of the first parasitic branch is perpendicular to the fourth branch segment of the second parasitic branch;

wherein the third antenna portion comprises a third antenna branch and a third parasitic branch;

the third parasitic branch is positioned between the third antenna branch and the first antenna branch;

the third parasitic branch is L-shaped, and the third parasitic branch comprises a fifth branch segment and a sixth branch segment; and a first end of the fifth branch segment is in contact to the ground region, a second end of the fifth branch segment is joined to a first end of the sixth branch segment, and a second end of the sixth branch segment points towards the first antenna branch; and wherein the first antenna branch and the second antenna branch run opposite to each other, and the second antenna branch and the third antenna branch run opposite to each other.

8. The terminal middle-frame according to claim 7, wherein the first antenna branch and the second antenna branch are L-shaped.

9. The terminal middle-frame according to claim 7, wherein a frequency band of the first antenna portion and a frequency band of the second antenna portion are identical; or the frequency band of the first antenna portion and the frequency band of the second antenna portion contain a same frequency band; or the frequency band of the first antenna portion and the frequency band of the second antenna portion contain respective frequency bands having a frequency difference between each other that is smaller than a required frequency difference.

10. The terminal middle-frame according to claim 7, wherein the first antenna portion, the second antenna portion and the third antenna portion are arranged in a line in the antenna.

11. The terminal middle-frame according to claim 7, wherein the first antenna portion and the second antenna portion are arranged on an industrial liquid crystal polymer material.

12. The terminal middle-frame according to claim 7, wherein the ground region is covered with a conductive material; or the ground region is made of a conductive material.

13. A terminal installed with an antenna, wherein the antenna comprises: a first antenna portion and a second antenna portion arranged adjacently, wherein the antenna further comprises a third antenna portion, and the first antenna portion is positioned between the third antenna portion and the second antenna portion;

wherein the first antenna portion comprises a first antenna branch and a first parasitic branch, and the second antenna portion comprises a second antenna branch;

the first parasitic branch is positioned between the first antenna branch and the second antenna branch;

the first parasitic branch comprises a first branch segment, a second branch segment, and an additional branch segment; and a first end of the first branch segment is in contact to a ground region, a second end of the first branch segment is joined to a first end of the second branch segment, and a second end of the second branch segment is joined to a first end of the additional branch segment and points towards the second antenna branch;

wherein the second antenna portion further comprises a second parasitic branch, and the second parasitic branch is positioned between the first parasitic branch and the second antenna branch;

the second parasitic branch is L-shaped, and the second parasitic branch comprises a third branch segment and a fourth branch segment; and a first end of the third branch segment is in contact to the ground region, a second end of the third branch segment is joined to a first end of the fourth branch segment, and a second end of the fourth branch segment points towards the first antenna branch;

wherein the additional branch segment of the first parasitic branch is parallel to the first branch segment of the first parasitic branch, such that the additional branch segment of the first parasitic branch is perpendicular to the fourth branch segment of the second parasitic branch;

wherein the third antenna portion comprises a third antenna branch and a third parasitic branch;

the third parasitic branch is positioned between the third antenna branch and the first antenna branch;

the third parasitic branch is L-shaped, and the third parasitic branch comprises a fifth branch segment and a sixth branch segment; and a first end of the fifth branch segment is in contact to the ground region, a second end of the fifth branch segment is joined to a first end of the sixth branch segment, and a second end of the sixth branch segment points towards the first antenna branch; and wherein the first antenna branch and the second antenna branch run opposite to each other, and the second antenna branch and the third antenna branch run opposite to each other.

14. The terminal according to claim 13, wherein the first antenna branch and the second antenna branch are L-shaped.

15. The terminal according to claim 13, wherein a frequency band of the first antenna portion and a frequency band of the second antenna portion are identical; or the frequency band of the first antenna portion and the frequency band of the second antenna portion contain a same frequency band; or the frequency band of the first antenna portion and the frequency band of the second antenna portion contain respective frequency bands having a frequency difference between each other that is smaller than a required frequency difference.

* * * * *